US008591354B2

(12) United States Patent
Yokota

(10) Patent No.: US 8,591,354 B2
(45) Date of Patent: Nov. 26, 2013

(54) GOLF CLUB HEAD

(75) Inventor: Masatoshi Yokota, Kobe (JP)

(73) Assignee: SRI Sports Limited, Kobe (JP)

( * ) Notice: Subject to any disclaimer, the term of this patent is extended or adjusted under 35 U.S.C. 154(b) by 478 days.

(21) Appl. No.: 12/840,868

(22) Filed: Jul. 21, 2010

(65) Prior Publication Data

US 2011/0021289 A1 Jan. 27, 2011

(30) Foreign Application Priority Data

Jul. 22, 2009 (JP) ..... 2009-170781

(51) Int. Cl.
*A63B 53/04* (2006.01)

(52) U.S. Cl.
USPC ..... 473/346; 473/345

(58) Field of Classification Search
USPC ..... 473/346, 328, 245
See application file for complete search history.

(56) References Cited

U.S. PATENT DOCUMENTS

| | | | | |
|---|---|---|---|---|
| 5,908,356 | A * | 6/1999 | Nagamoto | 473/224 |
| 7,273,423 | B2 * | 9/2007 | Imamoto | 473/332 |
| 7,294,064 | B2 * | 11/2007 | Tsurumaki et al. | 473/329 |
| 7,819,758 | B2 * | 10/2010 | Matsunaga et al. | 473/345 |
| 8,012,038 | B1 * | 9/2011 | Beach et al. | 473/329 |
| 2005/0221913 | A1 * | 10/2005 | Kusumoto | 473/345 |
| 2006/0122004 | A1 * | 6/2006 | Chen et al. | 473/335 |
| 2006/0172818 | A1 | 8/2006 | Yamamoto | |
| 2010/0048324 | A1 * | 2/2010 | Wada et al. | 473/346 |

FOREIGN PATENT DOCUMENTS

| | | | |
|---|---|---|---|
| JP | 4-327864 | A | 11/1992 |
| JP | 7-265470 | A | 10/1995 |
| JP | 2003-265655 | * | 9/2003 |
| JP | 2003-265655 | A | 9/2003 |
| JP | 2004-135858 | * | 5/2004 |
| JP | 2004-135858 | A | 5/2004 |
| JP | 2005-143589 | A | 6/2005 |
| JP | 2006-204604 | A | 8/2006 |
| JP | 2006-230953 | A | 9/2006 |

OTHER PUBLICATIONS

Japanese Office Action, dated Nov. 29, 2011 for Japanese Application No. 2009-170781.

* cited by examiner

*Primary Examiner* — Stephen L. Blau
(74) *Attorney, Agent, or Firm* — Birch, Stewart, Kolasch & Birch, LLP

(57) ABSTRACT

When a length of a cross section CS1 in a face-back direction is defined as L; a point being 0.1L from a forefront point Mz2 of the cross section and positioned on an outer surface of the sole is defined as Ma; a point being 0.2L from a backmost point Mk2 of the cross section and positioned on the outer surface of the sole is defined as Md; intersection points of lines and the outer surface of the sole are defined as a point Mb and a point Mc from a face side in order, the lines equally dividing a distance between the point Ma and the point Md into three in the face-back direction; a distance of a cross section CS2 in the toe-heel direction is defined as W; intersection points of lines and the outer surface of the sole are defined as a point Mp, a point Mq, and a point Mr from a toe side in order, the lines equally dividing the distance W into four in the toe-heel direction; a radius of a circle passing through the point Ma, the point Mb, and the point Mc is defined as Ra; a radius of a circle passing through the point Mb, the point Mc, and the point Md is defined as Rb; and a radius of a circle passing through the point Mp, the point Mq, and the point Mr is defined as Rc, Ra>Rb>Rc is satisfied.

13 Claims, 13 Drawing Sheets

GOLF CLUB HEAD

This application claims priority on Patent Application No. 2009-170781 filed in JAPAN on Jul. 22, 2009, the entire contents of which are hereby incorporated by reference.

BACKGROUND OF THE INVENTION

1. Field of the Invention

The present invention relates to a hollow golf club head.

2. Description of the Related Art

Various shapes of soles are proposed in the hollow golf club head.

Paragraph [0038] of Japanese Patent Application Laid-Open No. 2005-143589 describes that a curvature radius of a sole is preferably 2.5 inches (63.5 mm) or greater and 4 inches (101.6 mm) or less.

Paragraph [0017] or the like of Japanese Patent Application Laid-Open No. 2004-135858 describes that a curvature radius of a sole in a face-back direction is 8.89 cm or greater and 15.24 cm or less. Paragraph [0072] of Japanese Patent Application Laid-Open No. 2004-135858 describes that the curvature radius of the sole in a toe-heel direction is 6.35 cm or greater and 8.89 cm or less. Paragraph [0073] of Japanese Patent Application Laid-Open No. 2004-135858 describes a case where the curvature radius of the sole in the toe-heel direction is greater than 8.89 cm.

[Claim 8] or the like of Japanese Patent Application Laid-Open No. 2003-265655 discloses a golf club head in which an average curvature radius of a sole in a toe-heel direction is 5.1 cm or greater and 7.6 cm or less and an average curvature radius thereof in a face-back direction is 8.9 cm or greater and 15.2 cm or less.

SUMMARY OF THE INVENTION

When the curvature radius of the sole is too small, the sitting of the head is apt to be degraded. The sitting of the head is the stability of the head at the time of address. The head is grounded in the case of the address. When the sitting of the head is degraded, the head is not stabilized to destabilize the direction of a face. When the sitting of the head is degraded, it becomes difficult to set the face to a target direction.

On the other hand, when the sole is flat, the rigidity of the sole is apt to be reduced. In this case, it was found that a good hitting sound is hardly obtained. It was found that the good hitting sound can be attained by a sole shape different from that of the conventional technique.

A golf club head of the present invention includes a face, a crown, and a sole. A length of a whole cross section CS1 in a face-back direction is defined as L, the cross section CS1 positioned at a center position in a toe-heel direction; a point being 0.1L from a forefront point of the cross section in the face-back direction and positioned on an outer surface of the sole is defined as Ma; a point being 0.2L from a backmost point of the cross section in the face-back direction and positioned on the outer surface of the sole is defined as Md; and intersection points of lines and the outer surface of the sole are defined as a point Mb and a point Mc from a face side in order, the lines equally dividing a distance between the point Ma and the point Md into three in the face-back direction. A distance of a whole cross section CS2 in the toe-heel direction is defined as W, the cross section CS2 being 20 mm from a forefront point of the head and being parallel to the toe-heel direction; and intersection points of lines and the outer surface of the sole are defined as a point Mp, a point Mq, and a point Mr from a toe side in order, the lines equally dividing the distance W into four in the toe-heel direction. A radius of a circle passing through the point Ma, the point Mb, and the point Mc is defined as Ra. A radius of a circle passing through the point Mb, the point Mc, and the point Md is defined as Rb. A radius of a circle passing through the point Mp, the point Mq, and the point Mr is defined as Rc. At this time, the radius Ra is greater than the radius Rb, and the radius Rb is greater than the radius Rc.

Preferably, the radius Ra is equal to or greater than 250 (mm). Preferably, the radius Rb is equal to or less than 200 (mm). Preferably, the radius Rc is equal to or less than 130 (mm).

Preferably, a rib is provided on an inner surface of the sole.

Preferably, when a point at which a minute section curvature radius Rs1 is minimal between the point Mc and the point Md in the cross section CS1 is defined as Me, the point Me is positioned on a back side from the point Mc.

Preferably, the sole has a projection part positioned on a back side from the point Me.

A golf club head which has a head having good sitting and a good hitting sound can be obtained.

DESCRIPTION OF THE PREFERRED EMBODIMENTS

The present invention will be described below in detail based on preferred embodiments with reference to the drawings.

Figure 1:
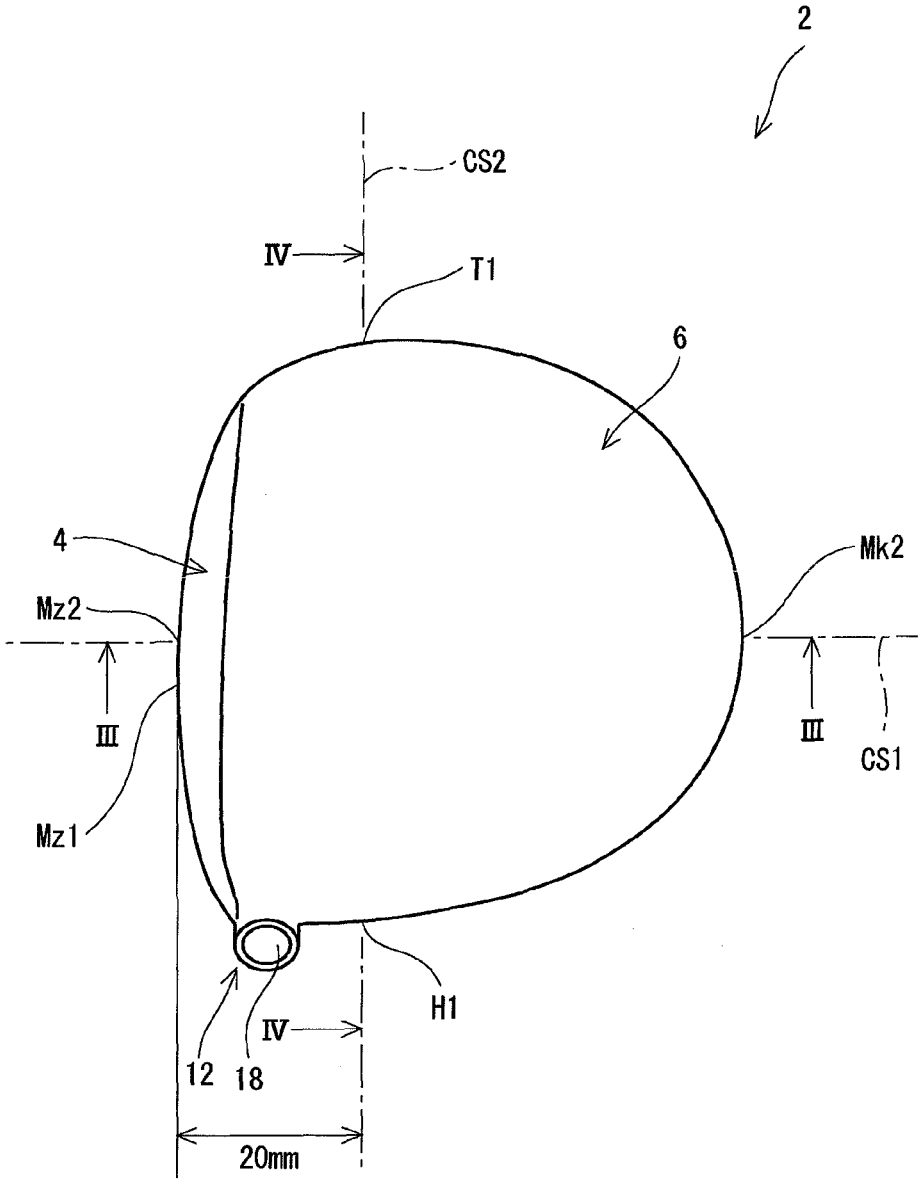
FIG. 1 shows a golf club head according to one embodiment of the present invention, as viewed from a crown side.
Figure 2:
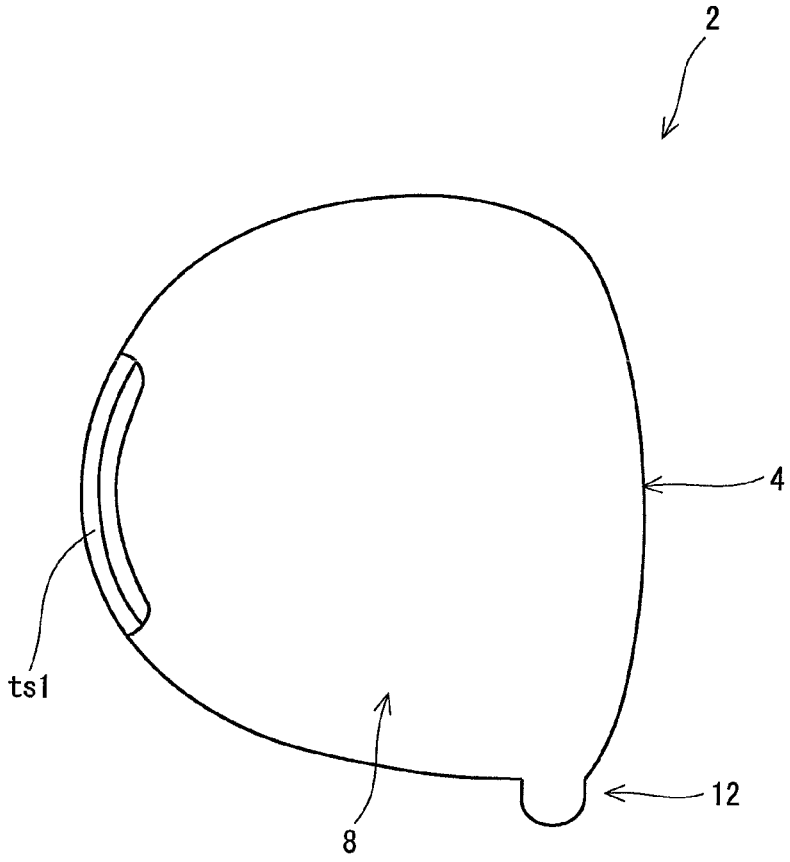
FIG. 2 shows the head of FIG. 1, as viewed from a sole side.
Figure 3:
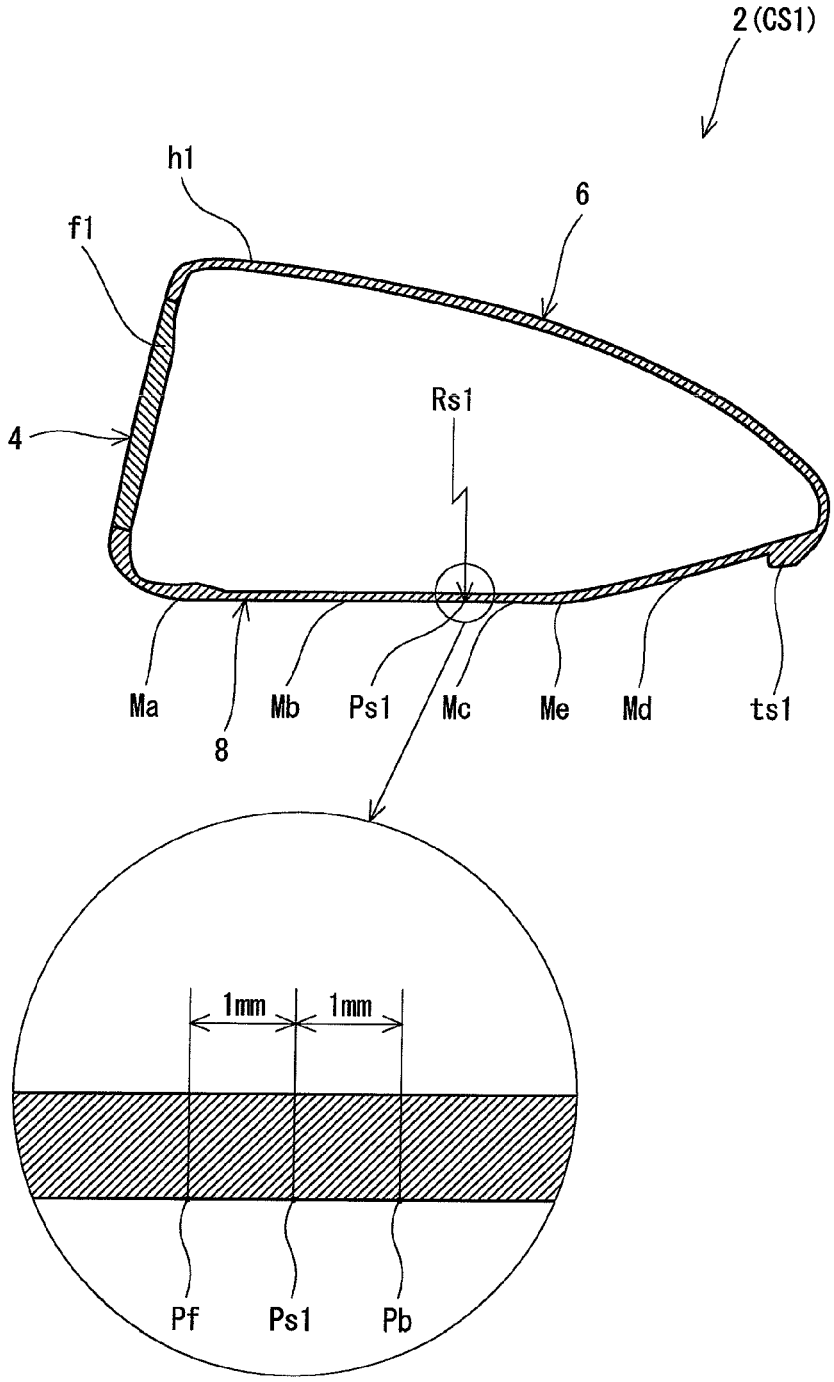
FIG. 3 is a cross sectional view taken in line III-III of FIG. 1, and is a cross section CS1.
Figure 4:
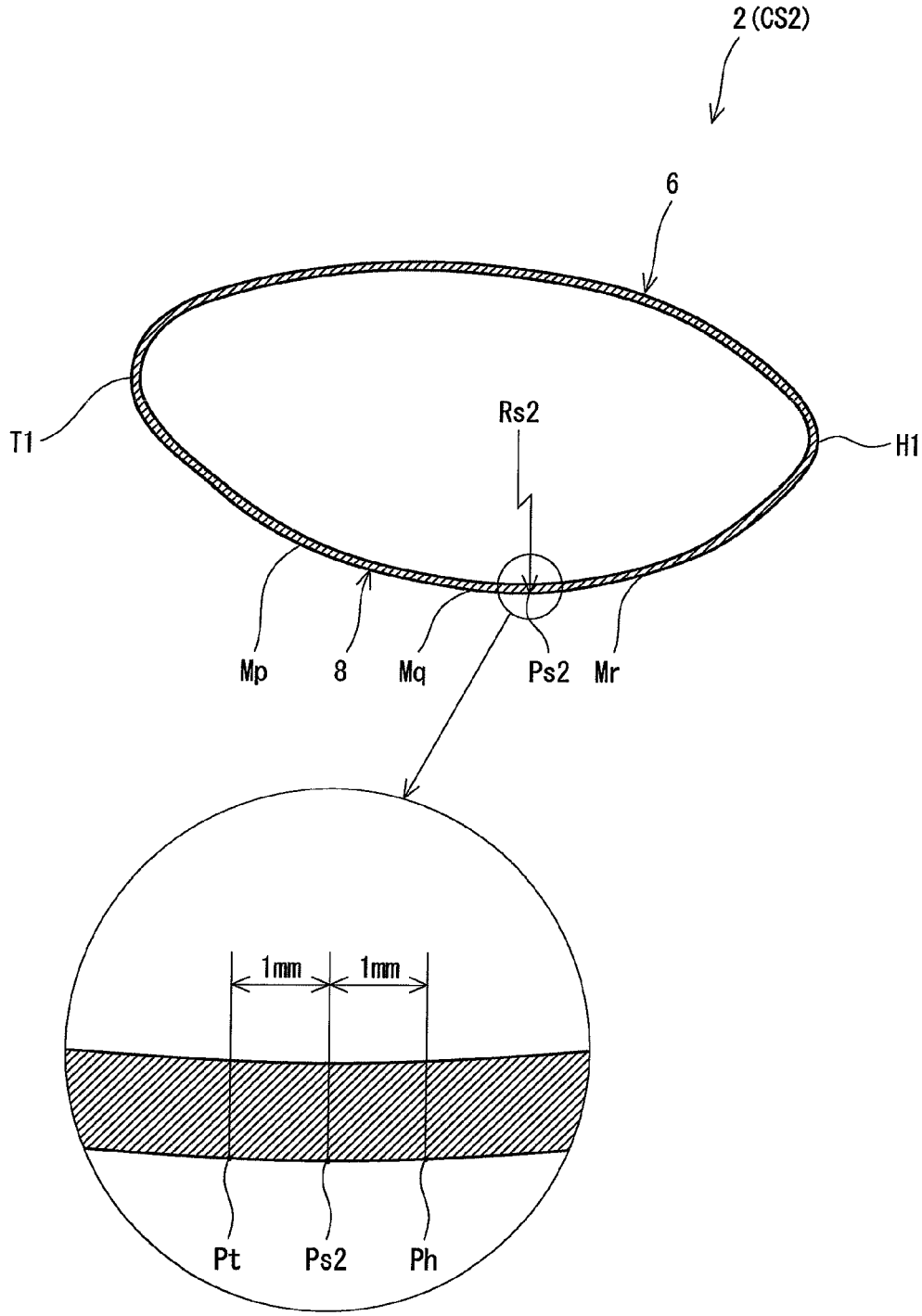
FIG. 4 is a cross sectional view taken in line IV-IV of FIG. 1, and is a cross section CS2.

FIG. 1 shows a golf club head 2 according to a first embodiment of the present invention, as viewed from a crown side. FIG. 2 shows the head 2, as viewed from a sole side. FIG. 3 is a cross sectional view taken in line III-III of FIG. 1. FIG. 4 is a cross sectional view taken in line IV-IV of FIG. 1.

The head 2 has a face 4, a crown 6, a sole 8, and a hosel 12. The crown 6 extends toward the rear of the head from the upper edge of the face 4. The sole 8 extends toward the rear of the head from the lower edge of the face 4. As shown in FIGS.

3 and 4, the inside of the head 2 is hollow. More specifically, the head 2 is hollow. The head 2 is a wood-type golf club head.

A portion between the sole 8 and the crown 6 is generally referred to as "a side". The head of the present invention may have this side. In the head 2 of this embodiment, a boundary between a portion which can be referred to as "the side" and the sole 8 is unclear. In such a case, in the present application, the sole 8 includes also the "portion which can be referred to as the side". The sole 8 of the head 2 includes the "portion which can be referred to as the side". Therefore, in the head 2, the periphery edge of the crown 6 is a boundary between the crown 6 and the sole 8.

The head 2 is produced by welding a head body h1 to a face member f1 (see FIG. 3). The head body h1 is manufactured by, for example, casting. The face member f1 is manufactured by, for example, forging or press working. The head body h1 is made of, for example, a titanium alloy. The face member f1 is made of, for example, a titanium alloy.

The face member f1 has a plate shape. The face member f1 constitutes a part of the face 4. The head body h1 constitutes the whole crown 6, the whole sole 8, a part of the face 4, and the whole hosel 12.

No rib exists on the inner surface of the head 2.

As shown in FIG. 1, the hosel 12 has a hole 18 for mounting a shaft. The shaft which is not shown is inserted into the hole 18. The hole 18 has a center axis line Z1 (not shown). This center axis line Z1 is substantially consistent with the shaft axis line of a golf club provided with the head 2.

The sole 8 has a projection part ts1 (see FIGS. 2 and 3). The projection part ts1 is formed on the outer surface of the head 2. The projection part ts1 is formed on the outer surface of the sole 8.

In the present application, a reference vertical plane, a face-back direction, and a toe-heel direction are defined. A state where the center axis line Z1 is included in a plane P1 perpendicular to a horizontal plane H and the head is put on the horizontal plane H at a predetermined lie angle and real loft angle is defined as a standard condition. The plane P1 is defined as the reference vertical plane.

In the present application, the toe-heel direction is a direction of an intersection line of the reference vertical plane and the horizontal plane H.

In the present application, the face-back direction is a direction perpendicular to the toe-heel direction and parallel to the horizontal plane H.

In the present application, the shape of the outer surface of the sole is considered. A recessed part for indicating a trade name, a count number, and a logo or the like may be formed in the outer surface of the sole. In the present invention, this recessed part is disregarded. In the present invention, a radius Ra, a radius Rb, and a radius Rc or the like are determined based on the shape of the outer surface of the sole. In this determination, partial projection parts such as the projection part ts1 to be described later are treated as not existing.

In the present application, "a cross section CS1 positioned at a center position in the toe-heel direction" is defined. When a point T1 positioned on the most toe side and a point H1 positioned on the most heel side in a cross section CS2 to be described later are defined (see FIG. 4), the position of a middle point TH1 of a straight line connecting the point T1 to the point H1 is defined as "the center position in the toe-heel direction". The cross section CS1 is a plane including the middle point TH1 and being perpendicular to the toe-heel direction.

In the present application, "the cross section CS2" is defined. This cross section CS2 is 20 mm from a forefront point Mz1 of the head in the face-back direction, and is a cross section formed by a plane parallel to the toe-heel direction. The forefront point Mz1 of the head is a point positioned on the most face side in the whole head.

In the present application, a point Ma, a point Mb, a point Mc, a point Md, and a point Me are defined. The point Ma, the point Mb, the point Mc, the point Md, and the point Me are points positioned on the cross section CS1.

Figure 5:
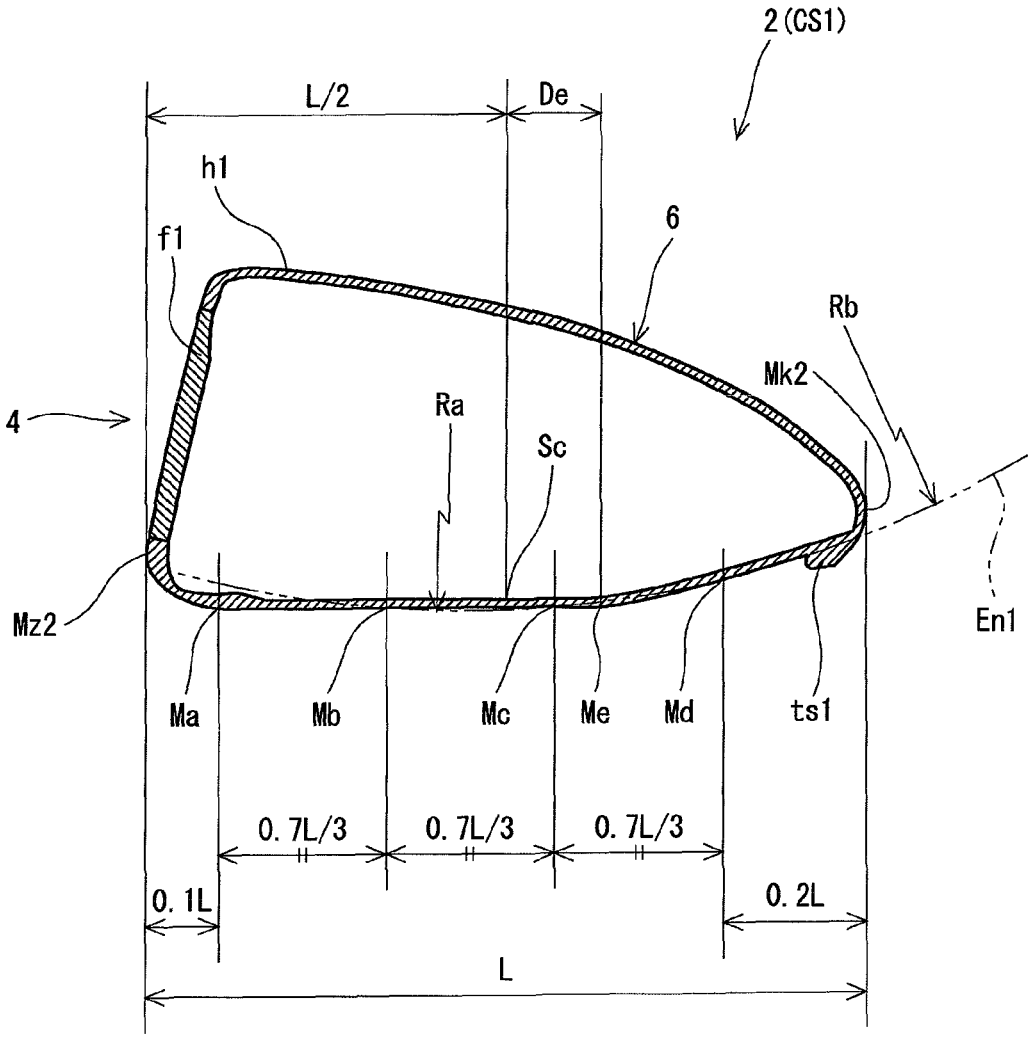
FIG. 5 is the same cross sectional view as that of FIG. 3, and is the cross section CS1.

FIG. 5 describes the point Ma, the point Mb, the point Mc, the point Md, and the point Me. FIG. 5 is the cross section CS1.

A distance between a forefront point Mz2 in the cross section CS1 and a backmost point Mk2 in the cross section CS1 in the face-back direction is shown by a two-headed arrow L in FIG. 5. The forefront point Mz2 in the cross section CS1 is also referred to as a cross section forefront point. The backmost point Mk2 in the cross section CS1 is also referred to as a cross section backmost point.

As shown in FIG. 5, the point Ma is a point positioned on the outer surface of the sole, and is (L/10) from the forefront point Mz2 in the face-back direction.

As shown in FIG. 5, the point Md is a point positioned on the outer surface of the sole, and is (2L/10) from the backmost point Mk2 in the face-back direction.

The point Mb is a point positioned on the outer surface of the sole, and is positioned on a back side from the point Ma. The point Mb is (0.7L/3) from the point Ma in the face-back direction.

The point Mc is a point positioned on the outer surface of the sole, and is positioned on a back side from the point Mb. The point Mc is (0.7L/3) from the point Mb in the face-back direction.

The distance between the point Ma and the point Mb in the face-back direction is equal to the distance between the point Mb and the point Mc in the face-back direction, and is also equal to the distance between the point Mc and the point Md in the face-back direction.

Therefore, a point being 0.1L from the cross section forefront point Mz2 in the face-back direction and positioned on the outer surface of the sole is the point Ma. A point being 0.2L from the cross section backmost point Mk2 in the face-back direction and positioned on the outer surface of the sole is the point Md. Intersection points of lines equally dividing a distance between the point Ma and the point Md into three in the face-back direction and the outer surface of the sole are the point Mb and the point Mc from a face side in order.

The point Me is a point at which a minute section curvature radius Rs1 is minimal between the point Mc and the point Md in the cross section CS1.

In the sole of the present application, the minute section curvature radius Rs1 is defined in all cross sections parallel to the cross section CS1. This curvature radius Rs1 can be determined in each of points belonging to the outer surface of the head. When a measuring point is defined as Ps1; a face side point separated by 1 (mm) from the measuring point Ps1 in the face-back direction is defined as Pf; and a back side point separated by 1 (mm) from the measuring point Ps1 in the face-back direction is defined as Pb, the minute section curvature radius Rs1 of the measuring point Ps1 is a radius of a circle passing through three points of the measuring point Ps1, the point Pf, and the point Pb (see an enlarged part of FIG. 3).

In the present application, a point Mp, a point Mq, and a point Mr are defined. The point Mp, the point Mq, and the point Mr are points positioned on the cross section CS2.

Figure 6:
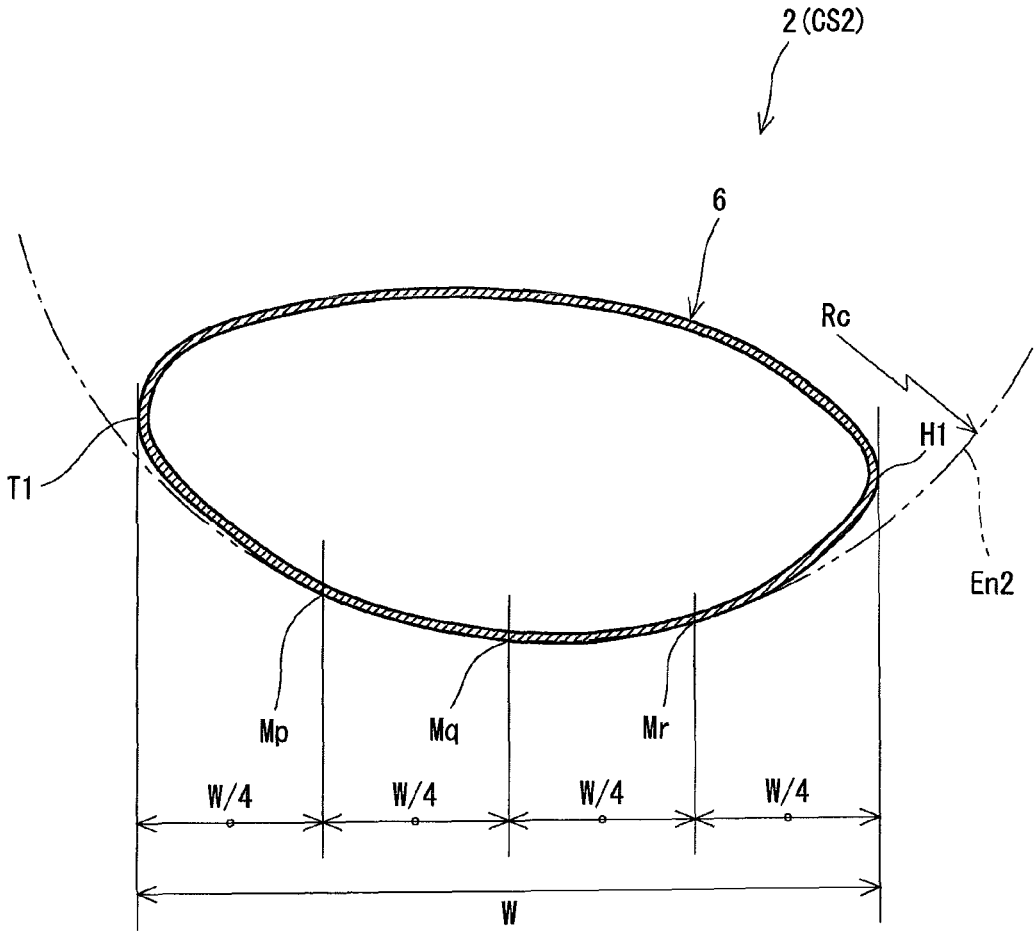
FIG. 6 is the same cross sectional view as that of FIG. 4, and is the cross section CS2.

FIG. 6 describes the point Mp, the point Mq, and the point Mr. FIG. 6 is the cross section CS2.

A distance between the point T1 and the point H1 in the toe-heel direction is shown by a two-headed arrow W in FIG. 6.

As shown in FIG. 6, the point Mp is a point positioned on outer surface of the sole, and is (W/4) from the point T1 in the toe-heel direction.

As shown in FIG. 6, the point Mq is a point positioned on the outer surface of the sole, and is (W/2) from the point T1 in the toe-heel direction.

As shown in FIG. 6, the point Mr is a point positioned on the outer surface of the sole, and is (W/4) from the point H1 in the toe-heel direction.

Therefore, in the cross section CS2, intersection points of lines and the outer surface of the sole are the point Mp, the point Mq, and the point Mr from the toe side in order, the lines equally dividing the distance W into four in the toe-heel direction.

In the present application, the radius Ra is defined. This radius Ra is a radius of a circle passing through the point Ma, the point Mb, and the point Mc. In the embodiment of FIG. 5, the point Ma, the point Mb, and the point Mc are positioned on the same straight line, and thereby the radius Ra is infinite.

In the present application, the radius Rb is defined. This radius Rb is a radius of a circle En1 passing through the point Mb, the point Mc, and the point Md (see FIG. 5).

In the present application, the radius Rc is defined. This radius Rc is a radius of a circle En2 passing through the point Mp, the point Mq, and the point Mr (see FIG. 6).

In the embodiment, the radius Ra is greater than the radius Rb. Furthermore, in the embodiment, the radius Rb is greater than the radius Rc.

As the radius Ra, the radius Rb, and the radius Rc are smaller, the flexure of the sole in hitting a ball tends to be suppressed. A pitch of a hitting sound is enhanced by suppressing the flexure of the sole, and a clear sound tend to be obtained. The high-pitched and clear hitting sound is felt comfortable. Furthermore, in the head of the present invention, it is found that the reverberation of the hitting sound tends to be felt long. In the case of the high-pitched sound and the long reverberation, it is found that the hitting sound is felt comfortable.

On the other hand, as the radius Ra, the radius Rb, and the radius Rc are smaller, the sitting of the head is apt to be degraded.

It is found that the sitting of the head and enhancement in the hitting sound can be simultaneously achieved when the radius Ra is greater than the radius Rb, and the radius Rb is greater than the radius Rc.

When the radius Ra and the radius Rb are larger, the center of gravity of the head tend to be lowered. The radius Ra and the radius Rb greater than the radius Rc contribute to the lowering of the center of gravity of the head. The low center of gravity tends to reduce a backspin speed immediately after the ball is hit. The low center of gravity tends to increase a launch angle. The low center of gravity contributes to the increase of a flight distance.

In respects of lowering the center of gravity of the head and of improving the sitting of the head, the radius Ra is preferably equal to or greater than 250 (mm), more preferably equal to or greater than 500 (mm), still more preferably equal to or greater than 700 (mm), and yet still more preferably substantially infinite.

In respects of suppressing the flexure of the sole and of enhancing the hitting sound, the radius Rb is preferably equal to or less than 200 (mm), more preferably equal to or less than 180 (mm), and still more preferably equal to or less than 150 (mm). In respect of lowering the position of the center of gravity, the radius Rb is preferably equal to or greater than 100 (mm), and more preferably equal to or greater than 120 (mm).

In respects of suppressing the flexure of the sole and of enhancing the hitting sound, the radius Rc is preferably equal to or less than 120 (mm), more preferably equal to or less than 115 (mm), and still more preferably equal to or less than 110 (mm). In respect of lowering the position of the center of gravity, the radius Rc is preferably equal to or greater than 85 (mm), and more preferably equal to or greater than 95 (mm).

A ratio [Ra/Rb] is not limited. In respects of the sitting of the head and of the hitting sound, the ratio [Ra/Rb] is preferably equal to or greater than 3, and more preferably equal to or greater than 4.

A ratio [Rb/Rc] is not limited. In respects of the lowering of the center of gravity and of the hitting sound, the ratio [Rb/Rc] is preferably equal to or greater than 1.1, and more preferably equal to or greater than 1.2. In respects of the lowering of the center of gravity and of the hitting sound, the ratio [Rb/Rc] is preferably equal to or less than 3, and more preferably equal to or less than 2.5.

A ratio [Ra/Rc] is not limited. In respects of the sitting of the head and of the hitting sound, the ratio [Ra/Rc] is preferably equal to or greater than 4, and more preferably equal to or greater than 5.

In respect of enhancing the sitting of the sole, at least a part of the cross section of the outer surface of the sole in the cross section CS1 between the point Ma and the point Me is preferably brought into contact with the horizontal plane H in the standard condition.

In respect of enhancing the sitting of the head, the point Me is preferably positioned on the back side from the point Mc.

In respect of lowering the center of gravity of the head while making the radius Rb less than the radius Ra, it is preferable that the sole 8 has the projection part ts1 positioned on the back side from the point Me (see FIG. 3). In respect of increasing the depth of the center of gravity, this projection part ts1 is preferably positioned on the back side from the point Md.

In the sole of the present application, a minute section curvature radius Rs2 is defined in all cross sections parallel to the cross section CS2 (see FIG. 4). This curvature radius Rs2 can be determined in each of points belonging to the outer surface of the head. When a measuring point is defined as Ps2; a toe side point separated by 1 (mm) from the measuring point Ps2 in the toe-heel direction is defined as Pt; and a heel side point separated by 1 (mm) from the measuring point Ps2 in the toe-heel direction is defined as Ph, the minute section curvature radius Rs2 of the measuring point Ps2 is a radius of a circle passing through three points of the measuring point Ps2, the point Pt, and the point Ph (see an enlarged part of FIG. 4).

Figure 7:
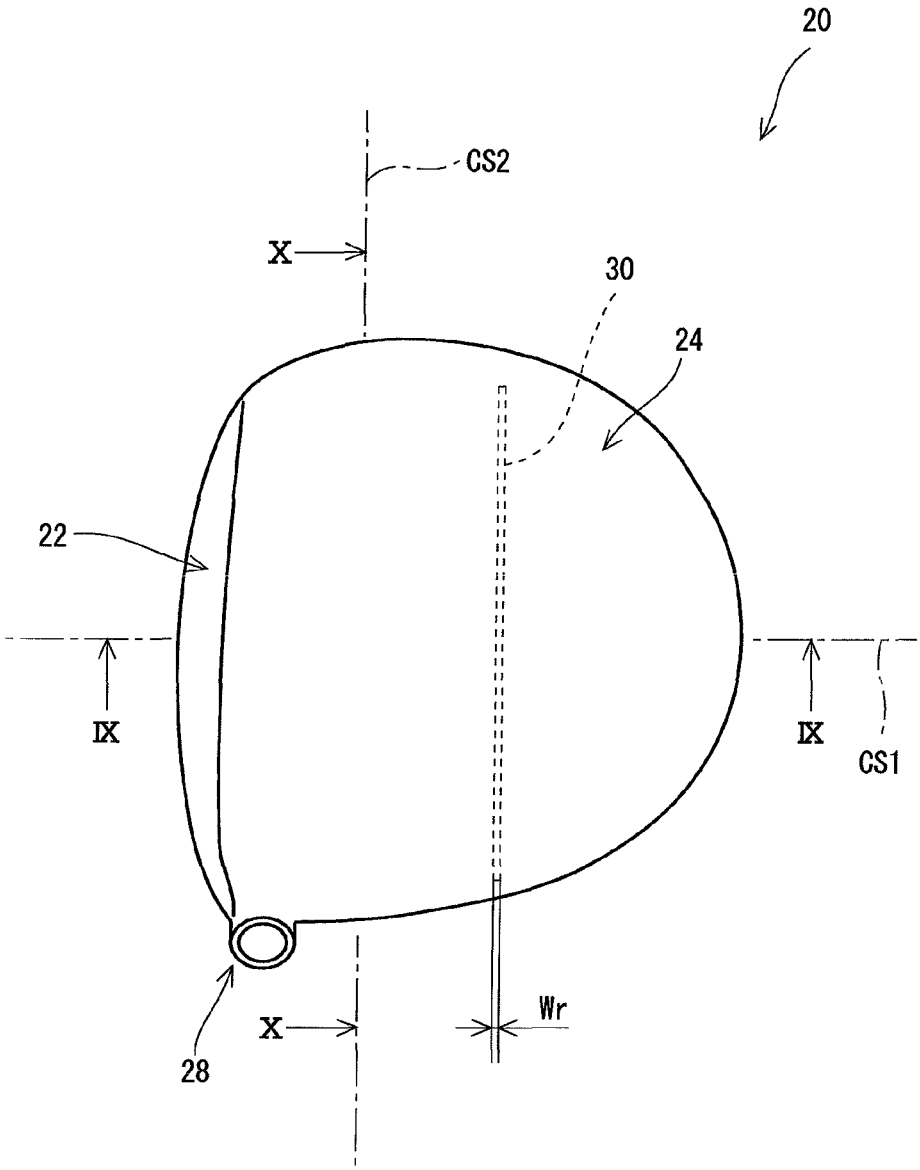
FIG. 7 shows a golf club head according to another embodiment of the present invention, as viewed from a crown side.
Figure 8:
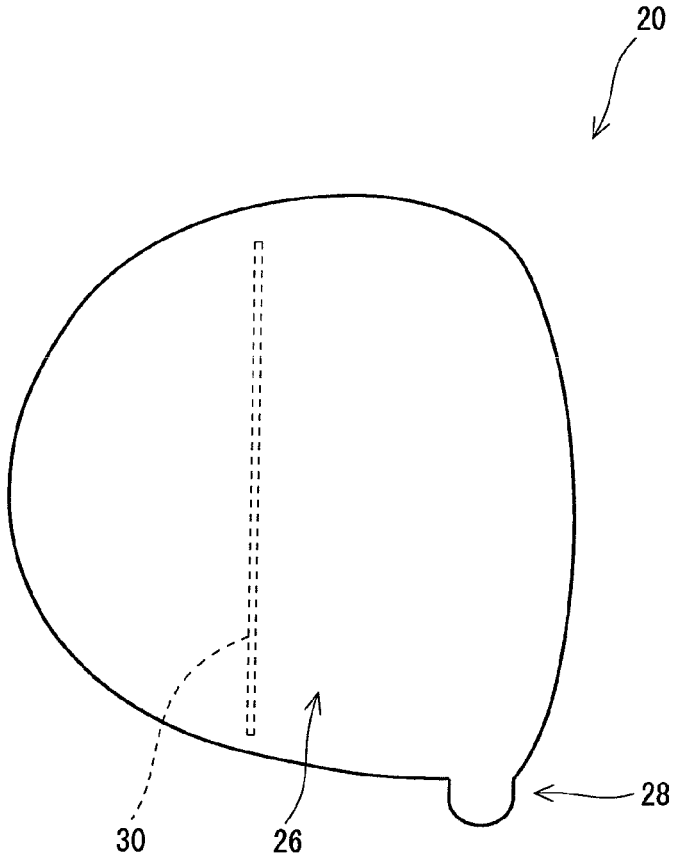
FIG. 8 shows the head of FIG. 7, as viewed from a sole side.
Figure 9:
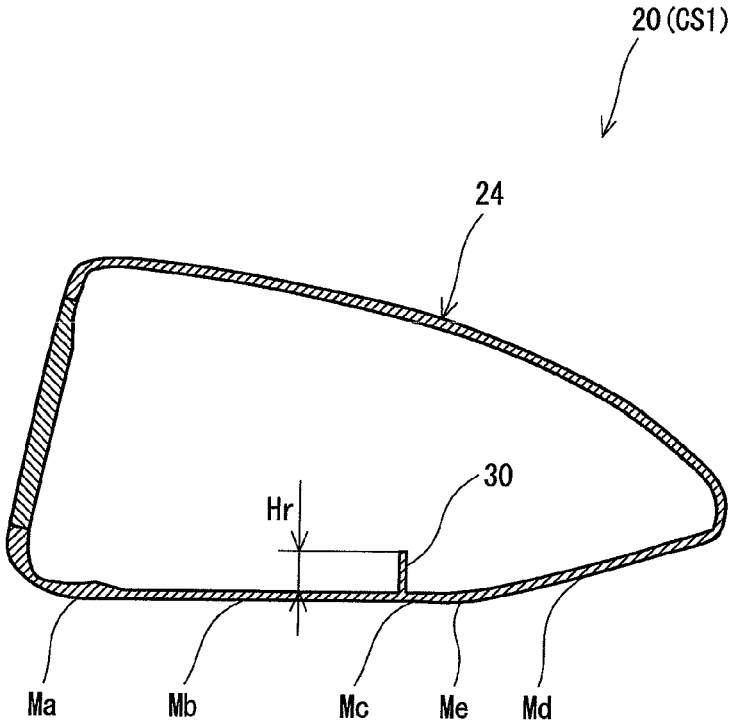
FIG. 9 is a cross sectional view taken in line IX-IX of FIG. 7, and is a cross section CS1.
Figure 10:
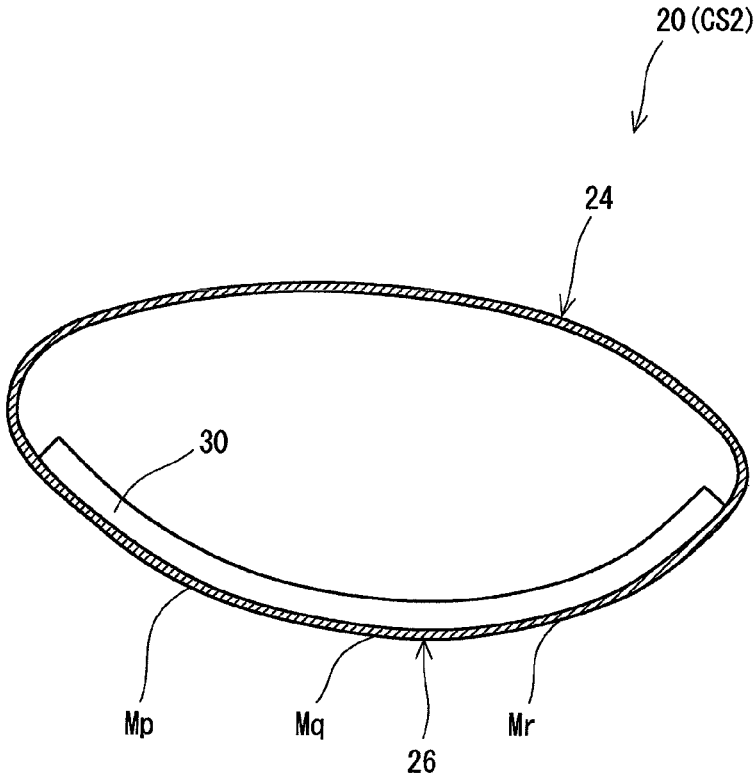
FIG. 10 is a cross sectional view taken in line X-X of FIG. 7, and is a cross section CS2.

FIG. 7 shows a golf club head 20 according to a second embodiment of the present invention, as viewed from a crown side. FIG. 8 shows the head 20, as viewed from a sole side. FIG. 9 is a cross sectional view taken in line IX-IX of FIG. 7. FIG. 10 is a cross sectional view taken in line X-X of FIG. 7.

The head 20 has a face 22, a crown 24, a sole 26, a hosel 28, and a rib 30. The head 20 is the same as the head 2 except for the rib 30.

As shown in FIGS. 9 and 10, the rib 30 is provided on the inner surface of the sole 26. The rib 30 is substantially provided along a toe-heel direction. Thus, in the head of the present invention, a rib may be provided on the inner surface of the sole 8. Since the rib suppresses the flexure of the sole, the rib is useful for enhancing a hitting sound.

Figure 11:
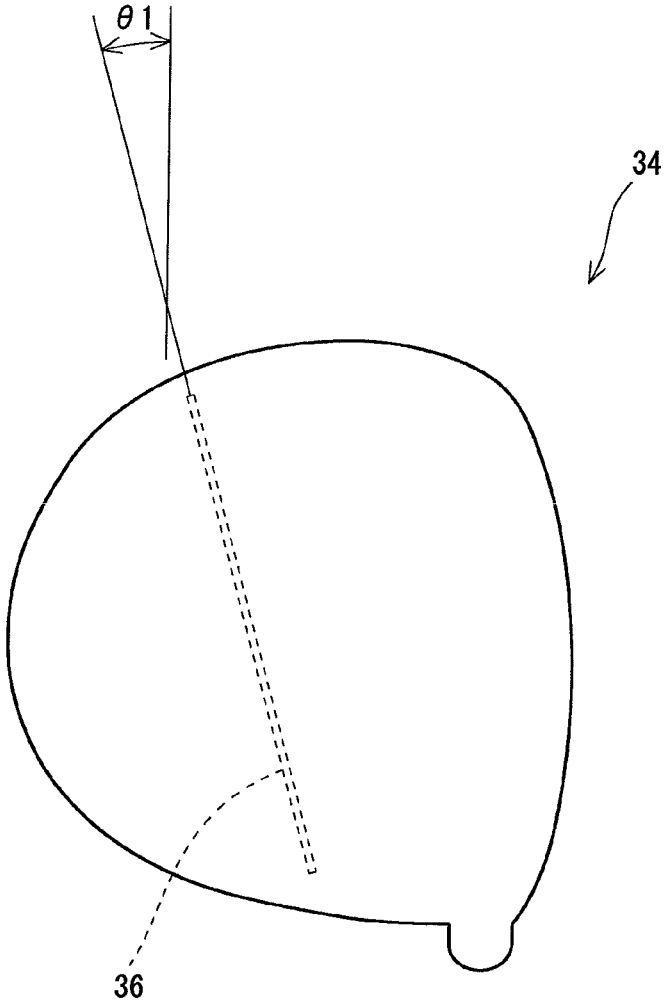
FIG. 11 shows a golf club head according to still another embodiment, as viewed from a sole side.

FIG. 11 shows a head 34 according to a third embodiment, as viewed from a sole side. This head 34 has a rib 36. The head 34 is the same as the head 20 except for the extending direction of a rib.

An angle (degree) between the extending direction of the rib and a toe-heel direction is shown by a two-headed arrow θ1 in FIG. 11. When the extending direction of the rib is curved, this angle θ1 is an angle between each of tangents of the rib and the toe-heel direction. This angle θ1 can be measured in a plan view as shown in FIG. 11.

Now, the inventor will consider that the sole of the embodiment is apt to be deformed in any mode. In order to considering this, first, the inventor consider a plate to which roundness (R) is applied only in one direction. More specifically, the inventor consider a plate Bd1 in which a cross section in a certain direction A is rounded and a cross section in a direction B perpendicular to the direction A is flat. That is, in this plate Bd1, roundness (R) is applied only in one direction. Such a plate Bd1 is apt to be deformed in a mode in which the plate Bd1 is curved along the direction B. In other words, such a plate Bd1 is apt to be deformed in a mode in which the roundness becomes larger (a curvature radius becomes smaller) or the roundness becomes less (the curvature radius becomes greater). As compared with this deformation, such a plate Bd1 is hardly deformed in a mode which the plate Bd1 is curved along the direction A. This concept is applied to the sole of the embodiment. As described above, the radius Rc is smaller than the radius Ra and the radius Rb. Therefore, in this case, the sole is apt to be deformed in a mode in which the curvature of the radius Rc is changed. In order to suppress this deformation, a rib extending in the toe-heel direction is effective. More specifically, when the radius Rc is smaller, the rib extending in the toe-heel direction tends to suppress the deformation of the sole as compared to the rib extending in the face-back direction.

Therefore, the extending direction of the rib provided on the sole is preferably close to the toe-heel direction. In respects of suppressing the vibration of the sole and of enhancing the hitting sound, the absolute value of the θ1 is preferably equal to or less than 20 degrees, and more preferably equal to or less than 10 degrees.

Figure 12:
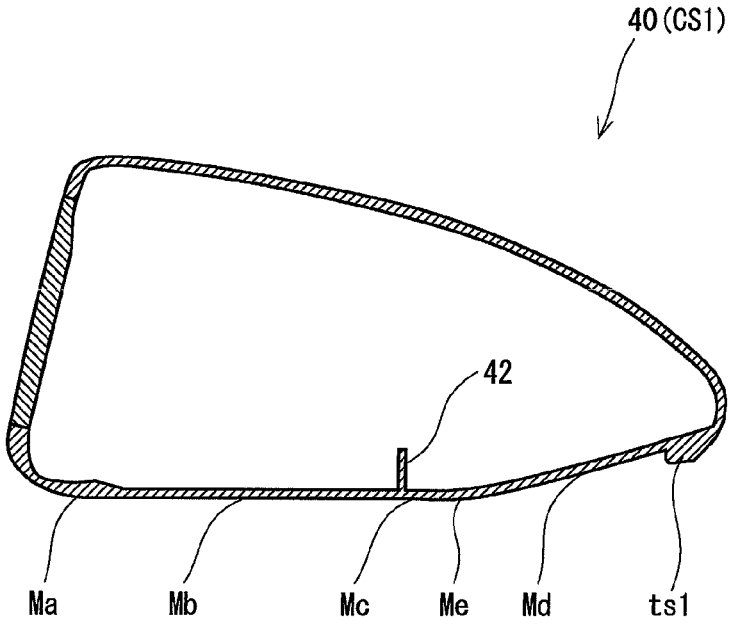
FIG. 12 is a cross sectional view of a golf club head according to still another embodiment, and is a cross section CS1.

FIG. 12 is a cross sectional view of a head 40 according to a third embodiment. This head 40 has a rib 42 and the projection part ts1. This head 40 is the same as the head 20 except for the existence of the projection part ts1. As in this head 40, both effects of the projection part ts1 and the rib 42 can be synergistically obtained by using the projection part ts1 in combination with the rib 42.

Figure 13:
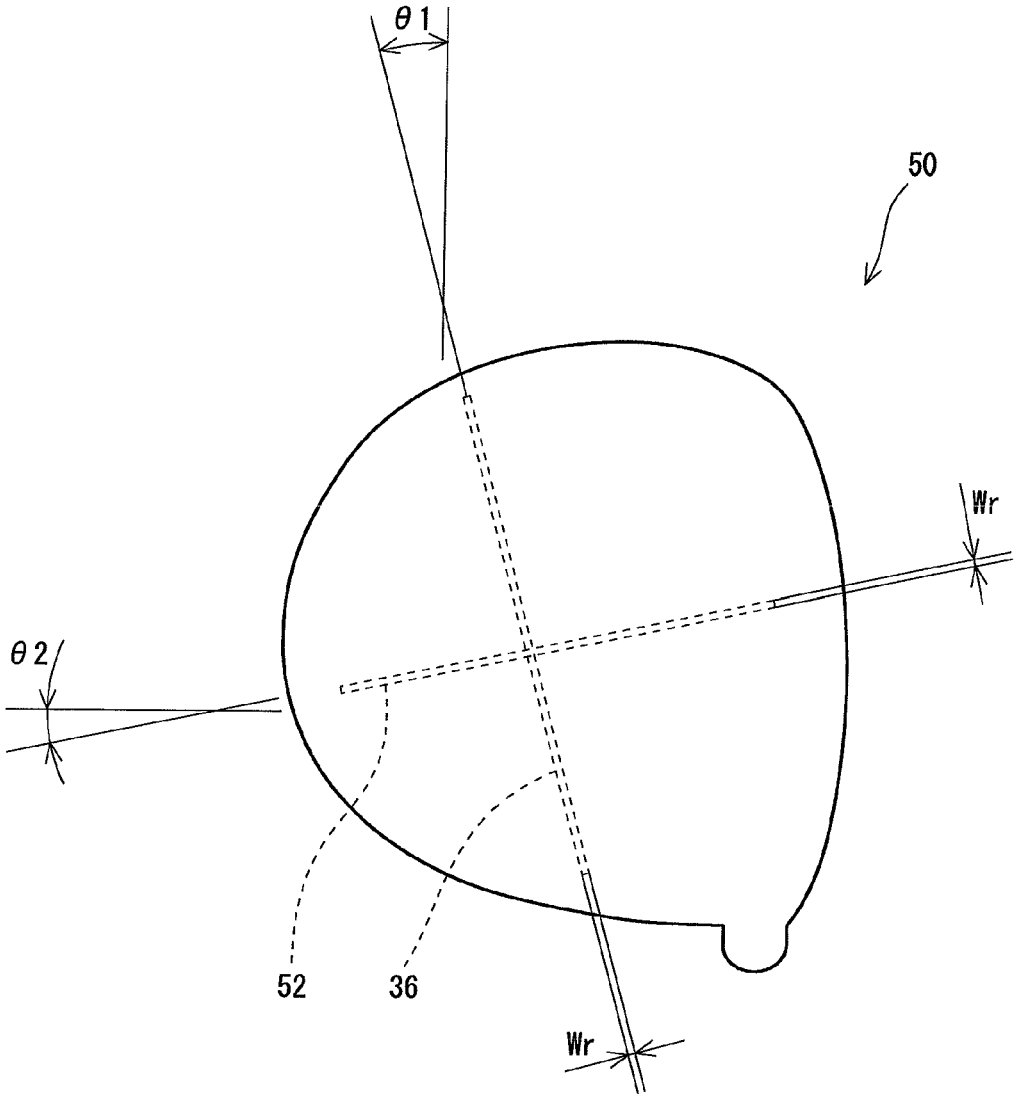
FIG. 13 shows a golf club head according to yet still another embodiment, as viewed from a sole side.

FIG. 13 shows a head 50 according to a fourth embodiment, as viewed from a sole side. This head 50 has the rib 36 and a rib 52. Both the rib 36 and the rib 52 are provided on the inner surface of the sole. The rib 36 and the rib 52 cross each other. This head 50 is the same as the head 34 except for the existence of the rib 52.

An angle (degree) between the extending direction of the rib and a face-back direction is shown by a two-headed arrow θ2 in FIG. 13. When the extending direction of the rib is curved, this angle θ2 is an angle between each of tangents of the rib and the face-back direction. This angle θ2 can be measured in a plan view as shown in FIG. 13.

In respect of suppressing the flexure of the sole changing the radius Ra and the radius Rb to improve the hitting sound, the absolute value of the angle θ2 is preferably equal to or less than 20 degrees, and more preferably equal to or less than 10 degrees.

In respect of enhancing the sitting of the head, the minute section curvature radius Rs1 in all positions on a face side from the point Me is preferably greater than the minute section curvature radius Rs1 in the point Me.

In respect of suppressing the flexure of the sole to improve the hitting sound, the minute section curvature radius Rs2 in all the positions of the sole is preferably equal to or less than 300 mm, more preferably equal to or less than 150 mm, and still more preferably equal to or less than 110 mm. In respect of lowering the center of gravity of the head, the minute section curvature radius Rs2 in all the positions of the sole is preferably equal to or greater than 50 mm, more preferably equal to or greater than 75 mm, and still more preferably equal to or greater than 95 mm.

The number of ribs is not limited. In respect of suppressing the flexure of the sole while suppressing the weight of the rib, the number of the ribs is preferably equal to or less than 3. When one rib is provided, in respect of improving the hitting sound while suppressing the weight of one rib, the absolute value of the angle θ1 in this rib is preferably equal to or less than 20 degrees, and more preferably equal to or less than 10 degrees. When two ribs are provided, in respect of improving the hitting sound while suppressing the weights of the ribs, one rib in which the absolute value of the angle θ1 is equal to or less than 20 degrees and one rib in which the absolute value of the angle θ2 is equal to or less than 20 degrees are preferably provided. One rib in which the absolute value of the angle θ1 is equal to or less than 10 degrees and one rib in which the absolute value of the angle θ2 is equal to or less than 10 degrees are more preferably provided.

The rib may extend in a curved condition. In respect of suppressing the flexure of the sole while suppressing the weight of the rib, more preferably, the rib extends straightly.

A distance between the point T1 and the point H1 in the toe-heel direction is shown by a two-headed arrow W in FIG. 6. In respect of the golf rules, the distance W is preferably less than 127 mm. In respects of ease to hitting and of moment of inertia, the distance W is preferably equal to or greater than 100 mm.

A distance between the forefront point Mz2 and the backmost point Mk2 in the face-back direction is shown by a two-headed arrow L in FIG. 5. In respect of the golf rules, the distance L is preferably is smaller than the distance W.

The volume of the head is not limited. In respects of the increase of the moment of inertia and of the enlargement of an sweet area, the volume of the head is preferably equal to or greater than 400 cc, more preferably equal to or greater than 420 cc, and still more preferably equal to or greater than 440 cc. In respect of observing the rules for the golf club, the volume of the head is preferably equal to or less than 470 cc, and particularly preferably 460 cc when the error of measurement of 10 cc is considered.

The weight of the head is not limited. In respect of swing balance, the weight of the head is preferably equal to or greater than 175 g, more preferably equal to or greater than 180 g, and still more preferably equal to or greater than 185 g. In respect of the swing balance, the weight of the head is preferably equal to or less than 220 g, more preferably equal to or less than 215 g, and still more preferably equal to or less than 210 g.

The weight of the rib is not limited. In respect of suppressing the flexure of the sole to obtain a high-pitched hitting sound, the weight of the rib is preferably equal to or greater than 1.0 g, more preferably equal to or greater than 1.2 g, and still more preferably equal to or greater than 1.5 g. When the weight of the rib is excessive, the weight capable of being distributed to the head body decreases, and the moment of inertia is reduced. From this respect, the weight of the rib is preferably equal to or less than 5.0 g, more preferably equal to or less than 4.0 g, and still more preferably equal to or less than 3.0 g.

In respect of suppressing the flexure of the sole to improve the hitting sound, the height Hr of the rib is preferably equal to or greater than 1 mm, more preferably equal to or greater than 2 mm, and still more preferably equal to or greater than 3 mm. In respect of suppressing the weight of the rib, the height Hr of the rib is preferably equal to or less than 10 mm, more preferably equal to or less than 8 mm, and still more preferably equal to or less than 6 mm.

In respect of suppressing the vibration of the sole to improve the hitting sound, the width Wr of the rib is preferably equal to or greater than 0.5 mm, and more preferably equal to or greater than 1 mm. In respect of suppressing the weight of the rib, the width Wr of the rib is preferably equal to or less than 10 mm, more preferably equal to or less than 5 mm, and still more preferably equal to or less than 3 mm.

A distance between the central point Sc of the sole and the point Me in the face-back direction is shown by a two-headed arrow De in FIG. 5. The central point Sc of the sole is a point positioned on the cross section CS1, and is L/2 (mm) from the forefront point Mz2 of the cross section in the face-back direction. The unit of this distance De is millimeter. This distance De is represented by plus(+) when the point Me is positioned on the back side from the point Sc, and is represented by minus(−) when the point Me is positioned on the face side from the point Sc.

In respect of the sitting of the head, the distance De is preferably equal to or greater than −20 (mm), more preferably equal to or greater than −10 (mm), and still more preferably equal to or greater than 0 (mm). In respect of suppressing the flexure of the face to improve the hitting sound, the distance De is preferably equal to or less than +10 mm.

The material for the head is not limited. As the material of the head, metal and CFRP (Carbon Fiber Reinforced Plastic) or the like are exemplified. As the metal used for the head, one or more kinds of metals selected from pure titanium, a titanium alloy, stainless steel, maraging steel, an aluminum alloy, a magnesium alloy and a tungsten-nickel alloy are exemplified. SUS630 and SUS304 are exemplified as stainless steel. As the specific example of stainless steel, CUSTOM450 (manufactured by CARPENTER TECHNOLOGY CORPORATION) is exemplified. As the titanium alloy, 6-4 titanium (Ti-6Al-4V), Ti-15V-3Cr-3Sn-3Al, Ti-8Al-1V-1Mo, and Ti-8Al-2V or the like are exemplified. When the volume of the head is equal or greater than 300 cc, in respects of strength and of rebound performance, the titanium alloy is preferable.

A part of the head may be made of a nonmetallic material having a specific gravity greater than that of the head body, or may be a weight member having a specific gravity smaller than that of the head body. Fiber-reinforced resins such as CFRP are exemplified as the nonmetallic material. CFRP means a carbon fiber reinforced plastic.

A method for manufacturing the head is not limited. Usually, a hollow head is manufactured by bonding two or more members. A method for manufacturing the members constituting the head is not limited. As the method, casting, forging and press forming are exemplified. For example, the shape of the face member may be a plate shape, and may be a cup shape.

Examples of the structures of the heads include a two-piece structure obtained by bonding two members in which each of member is integrally formed, a three-piece structure obtained by bonding three members in which each of member is integrally formed, and a four-piece structure obtained by four members in which each of member is integrally formed. As a method for bonding the members, welding, brazing, adhering, press fitting, and caulking are exemplified.

EXAMPLES

Hereinafter, the effects of the present invention will be clarified by Examples. However, the present invention should not be interpreted in a limited way based on the description of Examples.

Example 1

A wood-type head was produced in the same manner as in the head 2 of the first embodiment. Ti-6Al-4V was used as the material of a head body. A lost-wax precision casting was used as a method for manufacturing the head body. Ti-6Al-4V was used as the material of a face member. The face member was obtained by performing press working on a rolling plate made of Ti-6Al-4V. The head body was welded to the face member. A real loft angle was set to 10 degrees, and a lie angle was set to 57.5 degrees. A volume of a head was set to 460 cc. A shaft and a grip were attached to the head to obtain a golf club having a club length of 45 inches. The specifications and evaluation results thereof are shown in the following Table 1.

Examples 2 to 8

A head and a golf club of each of Examples were obtained in the same manner as in Example 1 except for the specifications shown in Table 1. The specifications and evaluation results thereof are shown in the following Table 1.

Example 9

One rib parallel to a toe-heel direction was provided on the inner surface of a sole, and the same head as the head 20 was produced. A head and a golf club were obtained in the same manner as in Example 1 except for the existence of one rib and the specifications shown in Table 1. The specifications and evaluation results thereof are shown in the following Table 1.

Example 10

One rib parallel to a toe-heel direction was provided on the inner surface of a sole. Furthermore, one rib parallel to a face-back direction was provided. A head and a golf club were obtained in the same manner as in Example 1 except for the existence of two ribs and the specifications shown in Table 1. The specifications and evaluation results thereof are shown in the following Table 1.

Comparative Examples 1 to 3

A head and a golf club of each of Comparative Examples were obtained in the same manner as in Example 1 except for the specifications shown in Table 2. The specifications and evaluation results thereof are shown in the following Table 2.

Comparative Example 4

A head and a golf club were obtained in the same manner as in Example 10 except for the specifications shown in Table 2. The specifications and evaluation results thereof are shown in the following Table 2.

The sitting of the head, the pitch of the hitting sound, the reverberation of the hitting sound, and the liking of the hitting sound were evaluated as follows.

Evaluation Method

Ten average golfers used each of the clubs, and evaluated the sitting of the head, the pitch of hitting sound, the reverberation of the hitting sound, and the liking of the hitting sound. The evaluation was performed in five stages of point 1 to point 5. Ten golfers' scores were averaged, and the average score was evaluated. As the score is higher, the evaluation is higher. The evaluation results are shown in Tables 1 and 2. In Tables 1 and 2, a case where the average score is equal to or greater than point 4.5 is indicated as "A". A case where the average score is point 4 or greater and less than point 4.5 is indicated as "B". A case where the average score is point 3 or greater and less than point 4 is indicated as "C". A case where the average score is less than point 3 is indicated as "D".

The description hereinabove is merely for an illustrative example, and various modifications can be made in the scope not to depart from the principles of the present invention.

The invention claimed is:

1. A golf club head comprising a face, a crown, and a sole, wherein when a length of a cross section CS1 in a face-back direction is defined as L, the cross section CS1 positioned at a center position in a toe-heel direction; a point being 0.1 L from a forefront point of the cross section in the face-back direction and positioned on an outer surface of the sole is defined as Ma;

a point being 0.2L from a backmost point of the cross section in the face-back direction and positioned on the outer surface of the sole is defined as Md;

TABLE 1

Specifications and evaluation results of Examples

| | | | Examples | | | | | | | | | |
|---|---|---|---|---|---|---|---|---|---|---|---|---|
| | | | 1 | 2 | 3 | 4 | 5 | 6 | 7 | 8 | 9 | 10 |
| Curvature radius of sole (mm) | | Ra | Infinite (flat) | Infinite (flat) | Infinite (flat) | 380 | Infinite (flat) | Infinite (flat) | Infinite (flat) | Infinite (flat) | Infinite (flat) | Infinite (flat) |
| | | Rb | 100 | 140 | 180 | 140 | 254 | 140 | 140 | 140 | 140 | 140 |
| | | Rc | 89 | 102 | 114 | 102 | 102 | 127 | 102 | 76 | 102 | 102 |
| Distance De (mm) ※1 | | | +10 | +10 | +10 | +10 | +10 | +10 | −20 | +10 | +10 | +10 |
| Rib (mm) | Toe-heel direction | Width Wr (mm) | none | none | none | none | none | none | none | none | 1 | 1 |
| | | Height Hr (mm) | | | | | | | | | 5 | 5 |
| | Face-back direction | Width Wr (mm) | none | none | none | none | none | none | none | none | none | 1 |
| | | Height Hr (mm) | | | | | | | | | | 5 |
| Height of center of gravity (mm) | | | 28 | 25 | 22 | 30 | 23 | 21 | 22 | 31 | 24 | 24 |
| Evaluation of hitting sound | Sitting of head | | B | B | B | C | B | B | C | B | B | B |
| | Pitch | | A | B | B | A | C | C | B | A | A | A |
| | Reverberation | | A | B | B | A | C | C | C | A | B | A |
| | Liking | | A | B | B | A | C | C | B | A | A | A |

※1: "+" and "−" respectively mean a back side and a face side from a center point Sc in a face-back direction

TABLE 2

Specifications and evaluation results of Comparable Examples

| | | | Comparative Examples | | | |
|---|---|---|---|---|---|---|
| | | | 1 | 2 | 3 | 4 |
| Curvature radius of sole (mm) | | Ra | 203 | 380 | Infinite (flat) | Infinite (flat) |
| | | Rb | 254 | 380 | 140 | 140 |
| | | Rc | 102 | 152 | 152 | 152 |
| Distance De (mm) ※1 | | | +10 | — | +10 | +10 |
| Rib (mm) | Toe-heel direction | Width Wr (mm) | none | none | none | 1 |
| | | Height Hr (mm) | | | | 5 |
| | Face-back direction | Width Wr (mm) | none | none | none | 1 |
| | | Height Hr (mm) | | | | 5 |
| Height of center of gravity (mm) | | | 32 | 30 | 28 | 27 |
| Evaluation of hitting sound | Sitting of head | | D | C | B | B |
| | Pitch | | B | D | D | D |
| | Reverberation | | B | D | D | B |
| | Liking | | B | D | D | D |

※1: "+" and "−" respectively mean a back side and a face side from a center point Sc in a face-back direction As shown in Tables 1 and 2, Examples have higher evaluation than those of Comparative Examples. Advantages of the present invention are clearly indicated by these evaluation results.

The invention described above is applicable to all types of hollow golf club heads. For example, the present invention is applicable to a driver, a fairway wood, a utility head, a hybrid head, and a hollow iron-type head or the like.

intersection points of lines and the outer surface of the sole are defined as a point Mb and a point Mc from a face side in order, the lines equally dividing a distance between the point Ma and the point Md into three in the face-back direction;

a distance of a cross section CS2 in the toe-heel direction is defined as W, the cross section CS2 being 20 mm from a forefront point of the head and being parallel to the toe-heel direction;

intersection points of lines and the outer surface of the sole are defined as a point Mp, a point Mq, and a point Mr from a toe side in order, the lines equally dividing the distance W into four in the toe-heel direction, then a radius of a circle passing through the point Ma, the point Mb, and the point Mc is defined as Ra, wherein the radius Ra is equal to or greater than 250 (mm);

a radius of a circle passing through the point Mb, the point Mc, and the point Md is defined as Rb, wherein the radius Rb is equal to or less than 200 (mm); and a radius of a circle passing through the point Mp, the point Mq, and the point Mr is defined as Rc, wherein the radius Rc is equal to or less than 130 (mm), and a ratio [Ra/Rb] is equal to or greater than 3; a ratio [Rb/Rc] is 1.1 or greater and 3 or less; and a ratio [Ra/Rc] is equal to or greater than 4.

2. The golf club head according to claim 1, wherein a rib is provided on an inner surface of the sole.

3. The golf club head according to claim 2, wherein when an angle between an extending direction of the rib and the toe-heel direction is θ1 (degree), an absolute value of the angle θ1 is equal to or less than 20 degrees.

4. The golf club head according to claim 2, wherein when an angle between an extending direction of the rib and the face-back direction is θ2 (degree), an absolute value of the angle θ2 is equal to or less than 20 degrees.

5. The golf club head according to claim 2, wherein a first rib is provided so that the absolute value of the angle θ1 with respect to the toe-heel direction is equal to or less than 20 degrees, and a second rib is provided so that the absolute value of the angle θ2 with respect to the face-back direction is equal to or less than 20 degrees.

6. The golf club head according to claim 2, wherein a rib height Hr of the rib is 1 mm or greater and 10 mm or less.

7. The golf club head according to claim 2, wherein a rib width Wr of the rib is 0.5 mm or greater and 10 mm or less.

8. The golf club head according to claim 1, wherein when a point at which a minute section curvature radius Rs1 is minimal between the point Mc and the point Md in the cross section CS1 is defined as Me, the point Me is positioned on a back side from the point Mc.

9. The golf club head according to claim 1, wherein when a point at which a minute section curvature radius Rs1 is minimal between the point Mc and the point Md in the cross section CS1 is defined as Me, the sole has a projection part positioned on a back side from the point Me.

10. The golf club head according to claim 1, wherein when a minute section curvature radius Rs2 is defined in all cross sections parallel to the cross section CS2, the minute section curvature radius Rs2 is 50 mm or greater and 300 mm or less at all positions of the outer surface of the sole.

11. The golf club head according to claim 1, wherein the distance W is 100 mm or greater and less than 127 mm.

12. The golf club head according to claim 1, wherein a volume of the head is 400 cc or greater and 470 cc or less.

13. The golf club head according to claim 1, wherein when a point at which a minute section curvature radius Rs1 is minimal between the point Mc and the point Md in the cross section CS1 is defined as Me; a point positioned on the cross section CS1 and being L/2 (mm) from the forefront point Mz2 of the cross section in the face-back direction is defined as a sole central point Sc; and a distance between the sole central point Sc and the point Me in the face-back direction is defined as De (mm), the distance De is −20 (mm) or greater and +10 mm or less, the distance De represented by plus(+) when the point Me is positioned on a back side from the point Sc and represented by minus(−) when the point Me is positioned on a face side from the point Sc.

* * * * *